US011963642B2

(12) United States Patent
Möller et al.

(10) Patent No.: US 11,963,642 B2
(45) Date of Patent: Apr. 23, 2024

(54) DISPENSER INSERT FOR DISPENSING SHEET PRODUCTS

(71) Applicant: Essity Hygiene and Health Aktiebolag, Gothenburg (SE)

(72) Inventors: Per Möller, Borlänge (SE); Karl Walheim, Borlänge (SE); Lars Thorén, Borlänge (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/428,398

(22) PCT Filed: Mar. 11, 2019

(86) PCT No.: PCT/EP2019/055972
§ 371 (c)(1),
(2) Date: Aug. 4, 2021

(87) PCT Pub. No.: WO2020/182284
PCT Pub. Date: Sep. 17, 2020

(65) Prior Publication Data
US 2022/0039617 A1 Feb. 10, 2022

(51) Int. Cl.
*A47K 10/42* (2006.01)
*A47F 1/08* (2006.01)
*A47K 10/32* (2006.01)

(52) U.S. Cl.
CPC ..... *A47K 10/424* (2013.01); *A47F 1/08* (2013.01); *A47K 2010/3233* (2013.01)

(58) Field of Classification Search
CPC ..... A47K 10/424; A47K 2201/02; A47F 1/08
See application file for complete search history.

(56) References Cited

U.S. PATENT DOCUMENTS 3,028,047 A * 4/1962 Tuft ..... A47K 10/424 221/199
3,381,909 A * 5/1968 Tucker ..... A47K 10/3836 242/560.3

(Continued)

FOREIGN PATENT DOCUMENTS

DE 102017205778 B3 8/2018
RU 2605178 C2 12/2016

(Continued)

OTHER PUBLICATIONS

International Preliminary Report on Patentability issued in corresponding International Application No. PCT/EP2019/055972 dated Feb. 16, 2021.

(Continued)

*Primary Examiner* — Gene O Crawford
*Assistant Examiner* — Kelvin L Randall, Jr.
(74) *Attorney, Agent, or Firm* — BUCHANAN INGERSOLL & ROONEY PC

(57) ABSTRACT

A dispenser insert for being mounted in an existing cabinet, the dispenser insert including a frame configured to be mounted in the cabinet, a dispensing mechanism mounted to the frame, the dispensing mechanism including a magazine part for accommodating a stack of sheet products and a dispensing part for dispensing the sheet products, the magazine part having a refilling access at its bottom, wherein the dispensing part is at least translationally moveable relative to the magazine part into a refilling position.

14 Claims, 9 Drawing Sheets

(56) References Cited

U.S. PATENT DOCUMENTS

| | | | | |
|---|---|---|---|---|
| 3,432,217 | A | 3/1969 | Cowan | |
| 5,137,173 | A * | 8/1992 | Hughes | A47K 10/424 221/48 |
| 5,611,456 | A * | 3/1997 | Kasper | E05B 17/04 221/242 |
| 5,957,324 | A | 9/1999 | Gettelman et al. | |
| 6,267,460 | B1 * | 7/2001 | Gaide | A47K 10/28 312/34.11 |
| 9,572,460 | B2 * | 2/2017 | Petocchi | A47K 10/3612 |
| 10,376,110 | B2 * | 8/2019 | Hall | A47K 10/424 |
| 2004/0099680 | A1 | 5/2004 | Mitchell | |
| 2006/0163419 | A1 | 7/2006 | Horn | |
| 2007/0023565 | A1 * | 2/2007 | Babikian | A47K 10/38 242/598.6 |
| 2014/0374433 | A1 | 12/2014 | Wilson | |
| 2015/0313425 | A1 * | 11/2015 | Thorén | A47K 10/427 221/1 |
| 2016/0051100 | A1 | 2/2016 | Formon et al. | |
| 2018/0035850 | A1 * | 2/2018 | Larsson | A47K 10/424 |

FOREIGN PATENT DOCUMENTS

| | | | |
|---|---|---|---|
| RU | 2615110 | C1 | 4/2017 |
| WO | 2013007302 | A2 | 1/2013 |
| WO | 2014065733 | A1 | 5/2014 |
| WO | 2014098670 | A1 | 6/2014 |

OTHER PUBLICATIONS

International Search Report (PCT/ISA/210) and Written Opinion (PCT/ISA/237) dated Oct. 15, 2019, by the European Patent Office as the International Searching Authority for International Application No. PCT/EP2019/055972.

Response to International Search Report and Written Opinion issued in corresponding International Application No. PCT/EP2019/055972 dated Dec. 16, 2020.

Office Action (Notification of the First Office Action) dated Dec. 13, 2021 by the National Intellectual Property Administration (CNIPA) of the People's Republic of China in corresponding Chinese Patent Application No. 201980092177.X, and an English Translation of the Office Action. (14 pages).

Office Action (Notification of the Second Office Action) dated May 7, 2022 by the National Intellectual Property Administration (CNIPA) of the People's Republic of China in corresponding Chinese Patent Application No. 201980092177.X, and an English Translation of the Office Action. (7 pages).

Office Action (Decision on Grant) dated Mar. 10, 2022, by the Federal Service for Intellectual Property in Russian Patent Application No. 2021129300/(062200) and an English Translation of the Office Action. (18 pages).

* cited by examiner

DISPENSER INSERT FOR DISPENSING SHEET PRODUCTS

TECHNICAL FIELD

The present disclosure relates to a dispenser insert for dispensing sheet products, particularly sanitary paper sheet products such as hand towels, paper napkins, facials, toilet paper, or other wiping products in sheet form. More particular, the disclosure relates to a dispenser insert to be mounted in an existing cabinet, preferably an existing recessed cabinet, for retrofitting. Furthermore, the present disclosure relates to a method for refilling a dispenser.

BACKGROUND

Sheet products are generally stacked and accommodated in a cabinet of a dispenser. The individual sheet products may be folded. Continuous dispensing of the folded sheet products from the dispenser is enabled by folding consecutive sheet products.

In many conventional dispenser types, a stack of sheet products accommodated in the cabinet is urged in a direction toward the dispensing opening. In the most simple configuration and if the cabinet is mounted so that the dispensing opening is directed downward, the stack of sheet products is urged toward the dispensing opening by gravity. In such dispensers, individual sheet products are withdrawn from the stack from the bottom thereof.

One problem with dispensers of this kind is that the total weight of the stack of sheet products is on the leading (lowermost) sheet product to be dispensed through the dispensing opening. This effect is even higher when dispensers of this kind are overloaded or overfilled with sheet products. This leads to a high pressure against a leading sheet product, thereby increasing the friction between the leading sheet product and the dispenser. Such increased friction may make it difficult to remove the sheet product from the dispenser. In the worst case, the sheet product may tear during withdrawal. Another problem is that a plurality of sheet products is withdrawn at a time leading to waste of sheet products.

Attempts have been made to solve the above problems by providing dispensing mechanisms in which the sheet products are not dispensed from the bottom, but from the top of the stack, for instance in WO 2014/065733 A1.

Another example of this technique is also given in WO 2013/007302 A2.

Dispensers of this kind are usually composed of a dispensing mechanism which is housed in a specifically designed dispenser cabinet having a dispensing opening. Such cabinets may be provided with doors to allow access to the dispensing mechanism for refilling the dispenser with stacks of web. Usually, such cabinets are mounted on walls to form so-called wall-mounted cabinets.

Regardless of the type of the dispensing mechanism, there also exist dispensers having cabinets which are partially or completely recessed within a wall. However, many of these recessed cabinet dispensers, like the one disclosed in U.S. Pat. No. 3,432,217 A, were originally constructed as dispensers for individual sheet products, wherein the leading sheet product is withdrawn from the bottom of the stack, thereby facing the above-described problems. Since recessed cabinets form part of a solid wall of a building, it is expensive and time-consuming to replace existing recessed dispensers with new recessed dispensers not having the above-described problems.

Therefore, there is a need to adapt or retrofit existing recessed dispenser cabinets with dispensers not having the above-described problems.

However, adapting or retrofitting existing recessed dispenser cabinets with dispensing mechanisms of a different technology also requires great effort. This is because dispensing mechanisms are often incompatible with the structure of existing recessed cabinets or components thereof, such as a bottom wall in which the dispensing opening is defined. Such components are usually firmly attached to or even integrally formed with the cabinet and cannot be easily modified or adapted to the dispenser mechanisms.

SUMMARY

Therefore, it is an object of the present disclosure to provide a dispenser insert and a method for refilling the same which are compatible with existing dispenser cabinets.

The above-described problems are solved by the dispenser insert according to claim 1 and the method according to claim 13. Preferred embodiments are set out in the dependent claims.

According to one aspect, a dispenser insert for being mounted in an existing cabinet and having the features defined in claim 1 is disclosed. The existing cabinet may be partially or completely recessed within a wall. The dispenser insert comprises a frame configured to be mounted in the cabinet and a dispensing mechanism mounted to the frame. The dispensing mechanism comprises a magazine part for accommodating a stack of sheet products and a dispensing part for dispensing the sheet products. The magazine part has a refilling access at its bottom. The dispensing part of the dispensing mechanism is at least translationally movable relative to the magazine part into a refilling position.

The dispensing mechanism may be of the kind of or based on the dispensing mechanism in which the sheet products are dispensed from the top of the stack, such as those disclosed in WO 2013/007302 A2 or WO 2014/065733 A1, the content of which is herewith incorporated in its entirety by reference. In this kind of dispensing mechanism, in order to ensure that a protruding part of the leading sheet, which protrudes from the dispensing opening, is easily accessible and graspable, a dispensing part for dispensing the sheet products needs to be closely arranged at the bottom wall of the cabinet in which the dispensing opening is defined. On the other hand, for refilling the dispensing mechanism, the dispensing part needs to be moved into a refilling position. In order to be able to refill the dispensing mechanism, the movement of the dispensing part into the refilling position must therefore not be hindered by the bottom wall of the cabinet.

In wall-mounted dispenser types, this is often realized by specifically designed dispenser cabinets, in which the bottom wall of the cabinet comprising the dispensing opening is attached to the door of the cabinet and moved away from the dispensing part together with the door upon opening the door.

However, as previously mentioned, in existing recessed dispenser cabinets, the bottom wall of the cabinet may be firmly attached to or even integrally formed with the cabinet. Therefore, the dispensing part cannot be easily moved from the bottom wall of the cabinet into the refilling position if it is closely arranged at the bottom wall of the cabinet to ensure proper graspability of the protruding part of the leading sheet. This leads to incompatibility issues with existing dispensing mechanisms.

Since the dispensing part of the dispensing mechanism according to the disclosure is at least translationally movable relative to the magazine part into a refilling position, it is possible to readily move the dispensing part away from the bottom wall of the cabinet, thereby enabling refilling of the dispensing mechanism. Hence, it is possible to closely arrange the dispensing part at the dispensing opening of the recessed cabinet and ensure that refilling can be properly performed, thereby overcoming the above-mentioned incompatibility issues.

In addition, various kinds and shapes of the bottom wall of recessed dispenser cabinets may exist. For example, the bottom wall may generally comprise a slanted or curved surface, as the one shown in U.S. Pat. No. 3,432,217 A, which may extend in an upward direction from the rear wall of the recessed cabinet. Moreover, such slanted or curved bottom walls may also comprise a vertical portion extending vertically upward from a frontmost end of the bottom wall.

By providing a dispensing part which is at least translationally movable relative to the magazine part into a refilling position, also such vertical portions of the bottom wall can be reliably overcome without hindering the movement of the dispensing part. Hence, with this configuration, the dispenser insert according to the disclosure can be mounted in various recessed cabinets whose bottom walls have different structures or shapes. As a result, there is no need to adapt the dispensing mechanism to the specific shapes of existing recessed cabinets, thereby reducing manufacturing costs.

In the present disclosure, the term "cabinet" refers to an existing cabinet. In contrast, the term "dispenser insert" of the present disclosure refers to a device to be mounted within such a cabinet.

The dispenser insert according to the disclosure can be mounted in an existing cabinet. The existing cabinet may be a recessed cabinet. For example the recessed cabinet may be completely recessed within a wall. In another example, the existing cabinet may also be only partially recessed within a wall while also protruding to some extent from the wall. Existing cabinets may generally comprise a first side wall, a second side wall opposing the first side wall and a rear wall extending between the first side wall and the second side wall. In addition, existing cabinets may be provided with a door for closing the cabinet in order to protect the dispensing mechanism and improve the appearance of the dispenser. In existing recessed cabinets, the door may be flush with the wall within which the recessed cabinet is arranged.

While the dispenser insert according to the disclosure is exemplarily described for being mounted in an existing recessed cabinet, the dispenser insert according to the disclosure may also be mounted in a cabinet which is not recessed within a wall, but mounted to a wall or freestanding.

The dispenser insert comprises a frame configured to be mounted in the cabinet. The frame may be mounted to the rear wall of the cabinet and/or to the side walls of the cabinet. The frame may be mounted in the cabinet with screws. However, the frame may also be mounted in the cabinet by means of adhesive tape, whereby it is not necessary to drill holes into the recessed cabinet and the associated wall. It is further conceivable, that the frame is mounted in the cabinet by means of hooks, clips, hook and loop fastener, or the like.

In an example, the frame may be mounted in the cabinet by means of a mounting structure. The mounting structure may be fastened to the bottom wall and/or the side walls of the cabinet at a rear edge of the dispensing opening. Fastening may be realized by means of clips, adhesive tape, hook and loop fastener, or the like, whereby the bottom wall may not be structurally modified. The mounting structure may comprise a connection portion to which a corresponding connecting portion of the frame may be connected.

The dispensing mechanism of the dispenser insert is mounted to the frame of the dispenser insert. For this purpose, the frame may comprise one or more than one connection portion to which the dispensing mechanism is mountable, for example detachably mountable. The dispensing mechanism may comprise connecting portions respectively connectable to the connection portions of the frame. Furthermore, the frame may be firmly attached to the dispensing mechanism or even integrally formed with the dispensing mechanism.

As previously mentioned, the dispensing mechanism may be a mechanism in which the sheet products are dispensed from the top of the stack. For this purpose, as mentioned above, individual sheet products may be connected by lines of weakness to form a web. A web may also be provided without lines of weakness to form a homogeneous web from which individual sheet products may be separated by means of a cutting edge. The web may be guided within the dispenser insert with one or more than one guiding element, such as a roll or the like in order to properly guide the web along a specific path to the dispensing opening of the cabinet. However, also other kinds of dispensing mechanisms are conceivable, such as dispensing mechanisms in which the sheet products are dispensed from the bottom of the stack. Moreover, sheet products may be individually provided.

The dispensing mechanism comprises a magazine part for accommodating a stack of sheet products. The magazine part may generally be smaller in size than the overall size of the dispensing mechanism, however, still be large enough for receiving the stack of sheet products without inhibiting the movement of the sheet products within the dispensing mechanism. According to an example, the magazine part may be sized for accommodating more than one stack of sheet products. The magazine part may be provided with a first side wall and a second side wall opposing the first side wall as well as a rear wall extending between the first side wall and the second side wall. Moreover, the magazine part may also be provided with a front wall or front wall portions extending on a front side of the magazine part between the first side wall and the second side wall.

The dispensing mechanism further comprises a dispensing part for dispensing the sheet products. The dispensing part is a part of the dispensing mechanism from which the leading sheet product is dispensed through the dispensing opening to the outside of the cabinet. The dispensing part may comprise one or more than one guide roll or the like for ensuring that the leading sheet product is properly guided through the dispensing opening and easily graspable by a user.

The magazine part has a refilling access at its bottom. A refilling access provided at the bottom of a magazine part is particularly useful if a dispensing mechanism is provided in which the sheet products are dispensed from the top of the stack. With such a configuration, it is possible to refill the magazine part even if the magazine part is not yet empty, but still contains sheet products. The refilling access may define the bottom end of the magazine part.

According to the disclosure, the dispensing part is at least translationally moveable relative to the magazine part into a refilling position. As described above, the refilling position of the dispensing part is a position which the dispensing part is located at during refilling of the magazine part. "Translationally moveable" may mean that each part of the dispensing part is moved by the same distance and in the same direction relative to the magazine part when the dispensing part is translationally moved. For example, the dispensing part may be translationally moveable relative to the magazine part so as to shorten a length of the dispensing mechanism in the up-down direction, wherein the up-down direction may be defined with respect to the recessed cabinet. Throughout this document, the up-down direction may also include directions not perfectly parallel with the up-down direction of the recessed cabinet, but inclined thereto. As described above, this movement may be particularly useful to move the dispensing part away from the bottom wall of the recessed cabinet, thereby enabling movement of the dispensing part into the refilling position. The dispensing part may also be translationally moveable relative to the magazine part so as to extend a length of the dispensing mechanism in the up-down direction. As described above, this movement may be particularly useful to move the dispensing part in a position close to the dispensing opening of the bottom wall, thereby ensuring that a leading sheet of the stack is easily graspable through the dispensing opening. In an example, not each part of the dispensing part, but only specific parts of the dispensing part may be translationally moveable relative to the magazine part.

Furthermore, in an example, the dispensing part may be telescopically moveable relative to the magazine part.

The dispensing part may be translationally and rotationally moveable relative to the magazine part into the refilling position.

"Rotationally movable" may mean that the dispensing part can be rotated about an axis of rotation. For example, each part of the dispensing part may be rotationally movable by the same angle of rotation about the axis of rotation. Alternatively, only specific parts of the dispensing part may be rotationally movable. Rotational movability of the dispensing part may be realized by means of hinges, a pin engaged with a hole, or the like.

As previously explained, the translational movability of the dispensing part is necessarily required to ensure that the dispensing part can be moved into the refilling position without the bottom wall of the cabinet hindering the dispensing part in its movement. With the dispensing part being translationally and rotationally movable relative to the magazine part, the dispensing part can be moved away from the refilling access, thereby exposing the refilling access and enabling refilling of the magazine part. Further, with this configuration, it is possible to expose the refilling access of the magazine part without having to detach the dispensing part from the magazine part.

The dispensing part may be manually or automatically movable relative to the magazine part into the refilling position. In case of manual movement, the dispensing part may further comprise holding means, such as a handle, which is graspable by a user and assists manual movement of the dispensing part.

Furthermore, the translational and/or rotational movement of the dispensing part relative to the magazine part may be guided by means of a guide rail, a guide slot, or the like.

The dispensing part may be rotatably mounted on a carriage, the carriage may be translationally movable relative to the magazine part.

The carriage may be mounted on the magazine part. The carriage may be slidable mounted on the magazine part. For this purpose, edges of the carriage may engage with edges of the magazine part in a rail-like manner. For example, the magazine part may comprise a slot into which the carriage is mounted in a rail-like manner. The dispensing part may be rotatably mounted on the carriage. For this purpose, the dispensing part may comprise a portion engaging with edges of the carriage in a rail-like manner as well. Furthermore, the dispensing part may be mounted on a bushing or the like, wherein the bushing is rotatably mounted on the carriage.

With this configuration, it is possible that the rotational and translational movements of the dispensing part at least overlap. This facilitates the movement of the dispensing part into the refilling position because the translational and rotational movements do not have to be performed after one another. For example, the dispensing part may be rotationally moved relative to the carriage and, in turn, relative to the magazine part, while the carriage may be translationally moved relative to the magazine part.

An end of the magazine part opposite to the refilling access may be rotatably attached to the frame.

As previously explained, the magazine part has the refilling access at its bottom. Therefore, the end of the magazine part opposite to the refilling access may be associated with the top of the magazine part. With the top or the upper end of the magazine part being rotatably attached to the frame, it is possible to pivot the whole magazine part about an axis of rotation which is located at the position where the end of the magazine part is attached to the frame. With this configuration, since the magazine part may be pivoted or rotated relative to the frame, it is possible to move the whole magazine part into a position in which the refilling access at the bottom of the magazine part is not covered by the bottom wall of the recessed cabinet, thereby facilitating refilling of the magazine part. For this purpose, the magazine part may be pivoted or rotated away from the rear wall of the recessed cabinet.

The frame may have a guide slot and the dispensing part may haves a pin engaged with the guide slot, whereby the magazine part may be rotated relative to the frame upon rotation of the dispensing part relative to the magazine part.

In an example, the frame may comprise side walls extending along the side walls of the magazine part. The guide slot of the frame may respectively be provided in the side wall of the frame and extend in an up-down direction. As previously mentioned, the dispensing part is rotationally movable relative to the magazine part about an axis of rotation. The pin, which is engaged with the guide slot, may be arranged on the dispensing part at a position which does not coincide with the position of the axis of rotation about which the dispensing part is rotationally movable relative to the magazine part, i.e. at an eccentric position. In this configuration, when the dispensing part is rotationally moved relative to the magazine part, since the pin is eccentrically arranged on the dispensing part and engaged with the slot provided in the frame, the magazine part is moved relative to the frame. Further, since the magazine part is rotatably attached to the frame at an end of the magazine part, the magazine part is rotated relative to the frame upon rotation of the dispensing part relative to the magazine part.

With this configuration, it is possible to expose the refilling access by rotationally moving the dispensing part relative to the magazine part and, at the same time, rotate or pivot the magazine part relative to the frame in a position enabling easy access to the refilling access. Since these both movements are structurally combined, less action is required by a user in order to refill the magazine part.

The dispensing part may comprise a guide configured to be supported on a slanted surface of the cabinet and to assist the translational and rotational movement of the dispensing part relative to the magazine part.

As described above, the bottom wall of the recessed cabinet which comprises the dispensing opening may generally have a slanted and/or curved surface. The guide may be arranged on a lower portion of the dispensing part close the bottom wall of the cabinet and be in contact with the slanted surface so as to be supported thereon. For example, the slanted surface of the bottom wall may be a smooth metallic surface. In this case, the guide may comprise a felt-like surface which is configured to easily slide over the slanted surface. However, the guide may also comprise a rail-like element being in contact with an associated part of the slanted surface so as to guide the dispensing part when the dispensing part is translationally and rotationally moved relative to the magazine part. In an example, the guide may be rotatably mounted on the dispensing part.

With this configuration, since the guide is configured to be supported on the slanted surface of the cabinet and to assist the translational and rotational movement of the dispensing part relative to the magazine part, it is possible for a user to move the dispensing part relative to the magazine part into the refilling position simply by, for example, pulling the magazine part on its handle in a forward direction, without paying extra attention that the dispensing part does not come into contact with the bottom wall of the cabinet during movement. Hence refilling the magazine part is facilitated and wear and tear of the dispensing part is prevented.

The guide may comprise a rotatable wheel.

The rotatable wheel may have a stronger curvature than the curved and/or slanted surface of the bottom wall of the cabinet in order to allow proper rotation of the rotatable wheel during movement of the dispensing part relative to the magazine part into the refilling position. In an example, the rotatable wheel may comprise a rubber element, such as a rubber ring, arranged around the outer diameter of the rotatable wheel. Such a configuration reduces wear and tear of the rotatable wheel. In an example, the dispensing part may comprise two rotatable wheels, each respectively arranged at an end portion of the dispensing part. For example, the rotatable wheels may have a diameter of 4 to 10 cm. In an example, the rotatable wheels may have a diameter of about 7 cm.

The magazine part may comprise a body and a support configured to support the stack of sheet products, the support may be translationally movable relative to the body upon translational movement of the dispensing part relative to the magazine part.

As previously mentioned, the magazine part may comprise first and second side walls, and a rear wall. The body may be composed of the first and second side walls, and the rear wall to provide an interior space in which the stack of sheet products can be accommodated. The support may be located at the refilling access of the magazine part. The support may comprise a wall- or plate-like portion on which the stack of sheet products can rest when being accommodated within the magazine part. In an example, the support may comprise two wall- or plate-like portions opposing each other and configured to support opposing end portions of the stack of sheet products.

The support is translationally movable relative to the body upon translational movement of the dispensing part relative to the magazine part. For this purpose, the support may be connected to the dispensing part. The support may also be connected to the carriage which is translationally movable relative to the magazine part.

In an example, when the dispensing part is translationally moved relative to the magazine part in an upper direction, the support may be translationally moved relative to the body also in an upper direction to be located at an upper position. As a result, since the support is located at the upper position, the interior space of the magazine part for accommodating the stacks of sheet products is reduced. Hence, when the dispensing part is translationally moved relative to the magazine part in an upper direction in order to refill the magazine part, the interior space of the magazine part is reduced, thereby allowing only a reduced number of sheet products to be filled into the magazine part. Subsequent the refilling and closing of the dispensing part, the interior space is again increased to its initial volume. Accordingly, with this configuration, it is possible to prevent overfilling of the magazine part, thereby preventing that the sheet products are excessively compressed against each other which may lead to the dispensing problems described above.

The dispenser insert may further comprise a holding mechanism configured to temporarily hold the dispensing part in the refilling position.

In an example, the holding mechanism may comprise a locking mechanism comprising a latch or the like configured to hold the dispensing part in the refilling position. Moreover, the holding mechanism may also comprise an extension spring, a torsion spring, a spiral torsion spring, or the like. Furthermore, the holding mechanism may comprise a string, a thread, a chain, or the like which may be connected to the frame of the dispenser insert at one end thereof and to the dispensing part at the other end thereof in order to temporarily hold the dispensing part in the refilling position.

With this configuration, it is possible to facilitate refilling of the magazine part performed by a user because a user does not need to hold the dispensing part in the refilling position with his hands during refilling.

The holding mechanism may comprise a friction brake configured to inhibit the movement of the dispensing part upon movement into the refilling position, whereby the dispensing part may be temporarily held in the refilling position.

The friction brake may exert a braking force acting on the dispensing part so as to inhibit the movement of the dispensing part. In general, the braking force exerted by the friction brake on the dispensing part may be configured to become stronger the closer the dispensing part gets to the refilling position. When the dispensing part is in the refilling position, the braking force may be sufficiently strong to hold the dispensing part in the refilling position, i.e. without the need of additional means for holding the dispensing part in the refilling position.

The friction brake may be arranged at a position at which the dispensing part is connected to the magazine part. For example, the friction brake may be composed of elements connecting the dispensing part to the magazine part. In an example in which the dispensing part is connected to a bushing and the bushing is connected to the carriage which, in turn, is slidably connected to the magazine part, the friction brake may be formed by the magazine part, the carriage, and the bushing. For example, the bushing may have an oval or elliptical shape and may thus press against a movable portion of the carriage upon movement of the dispensing part into the refilling position. The movable portion of the carriage, in turn, may press against the magazine part, thereby inhibiting the movement of the carriage and of the dispensing part into the refilling position.

With this configuration, it is possible to obtain a smooth movement of the dispensing part into the refilling position. If, for example, a user exerts a strong force when moving the dispensing part into the refilling position, the friction brake inhibits the movement of the dispensing part, thereby preventing the dispensing part from strongly hitting an abutment portion of the magazine part. The same effect takes place, if the dispensing mechanism is provided with coil springs or the like which are connected to the dispensing part and biased in order to assist or urge the movement of the dispensing part into the refilling position.

The dispensing part may be arranged below the refilling access.

In an example, the dispensing part may be arranged below the refilling access of the magazine part such that the foremost portions of the magazine part and the dispensing part may be substantially aligned or flush to one another. This configuration allows for a compact design of the dispensing mechanism and ensures that the dispensing mechanism does not interfere with the door of the cabinet. Such arrangement of the dispensing part with respect to the refilling access of the magazine part may be referred to as a "use position" of the dispensing part According to another aspect, a method for refilling a dispenser, the method having the features defined in claim 13, is disclosed. The method for refilling a dispenser comprising a dispensing mechanism having a magazine part for accommodating a stack of sheet products and a dispensing part for dispensing the sheet products, the magazine part having a refilling access at its bottom, comprises the steps of:

i) translationally moving the dispensing part relative to the magazine part in a first translational direction, ii) rotationally moving the dispensing part relative to the magazine part in a first rotational direction, iii) refilling the magazine part with the sheet products.

The dispenser may be a dispenser recessed within a wall, wherein the dispenser may comprise a cabinet recessed within the wall and having a bottom wall comprising a dispensing opening wherein the bottom wall is firmly attached to or integrally formed with the cabinet. The dispensing mechanism may be the same or may have the same features as the dispensing mechanism of the present disclosure.

In step i), the dispensing part is moved translationally relative to the magazine part in a first translational direction. The first translational direction may be an upward direction as seen in the up-down direction of the recessed cabinet. With this movement, it is possible to move the dispensing part away from the bottom wall in order to ensure that the bottom wall does not hinder the dispensing part in its movement.

In step ii), the dispensing part is moved rotationally relative to the magazine part in a first rotational direction. The first rotational direction may be an upwardly rotational direction away from the rear wall of the cabinet as seen in the up-down direction. With this movement, the dispensing part can be moved away from the refilling access, thereby exposing the refilling access and enabling refilling of the magazine part. The dispensing part may be manually or automatically moved relative to the magazine part.

In step iii), the magazine part is refilled with the sheet products. This step may complete the method for refilling the dispenser.

With this method, it is possible to readily refill a dispenser having a dispensing mechanism that is installed within a cabinet that is recessed within a wall, wherein the cabinet comprises a bottom wall in which the dispensing opening is formed and which is firmly attached to or integrally formed with the cabinet. Hence, the incompatibility issues described above can be readily overcome.

The method may further comprise the steps of:

iv) rotationally moving the dispensing part relative to the magazine part in a second rotational direction being opposite to the first rotational direction, v) translationally moving the dispensing part relative to the magazine part in a second translational direction being opposite to the first translational direction.

In step iv), the dispensing part is rotationally moved relative to the magazine part in a second rotational direction which is opposite to the first rotational direction. Since the first rotational direction may be an upwardly rotational direction away from the rear wall of the cabinet, the second rotational direction may be a downwardly rotational direction toward the rear wall of the cabinet as seen in the up-down direction of the cabinet. With this movement, the dispensing part can be brought back into the use position after refilling the magazine part with the sheet products.

In step v), the dispensing part is translationally moved relative to the magazine part in a second translational direction which is opposite to the first translational direction. Since the first translational direction may be an upward translational direction, the second translational direction may be a downward translational direction as seen in the up-down direction. With this movement, the dispensing part can be brought back in a position close to the dispensing opening of the bottom wall of the recessed cabinet, thereby enabling that a protruding part of a leading sheet is easily accessible and graspable by a user.

The movements of steps i) and ii) may at least overlap.

With this method, it is possible that the rotational and translational movements of the dispensing part at least overlap. This facilitates the movement of the dispensing part into the refilling position because the translational and rotational movements do not have to be performed after one another.

Further aspects of the present disclosure may be found in the following description of a particular embodiment making reference to the accompanying drawings.

DETAILED DESCRIPTION OF A PARTICULAR EMBODIMENT

Figure 1:
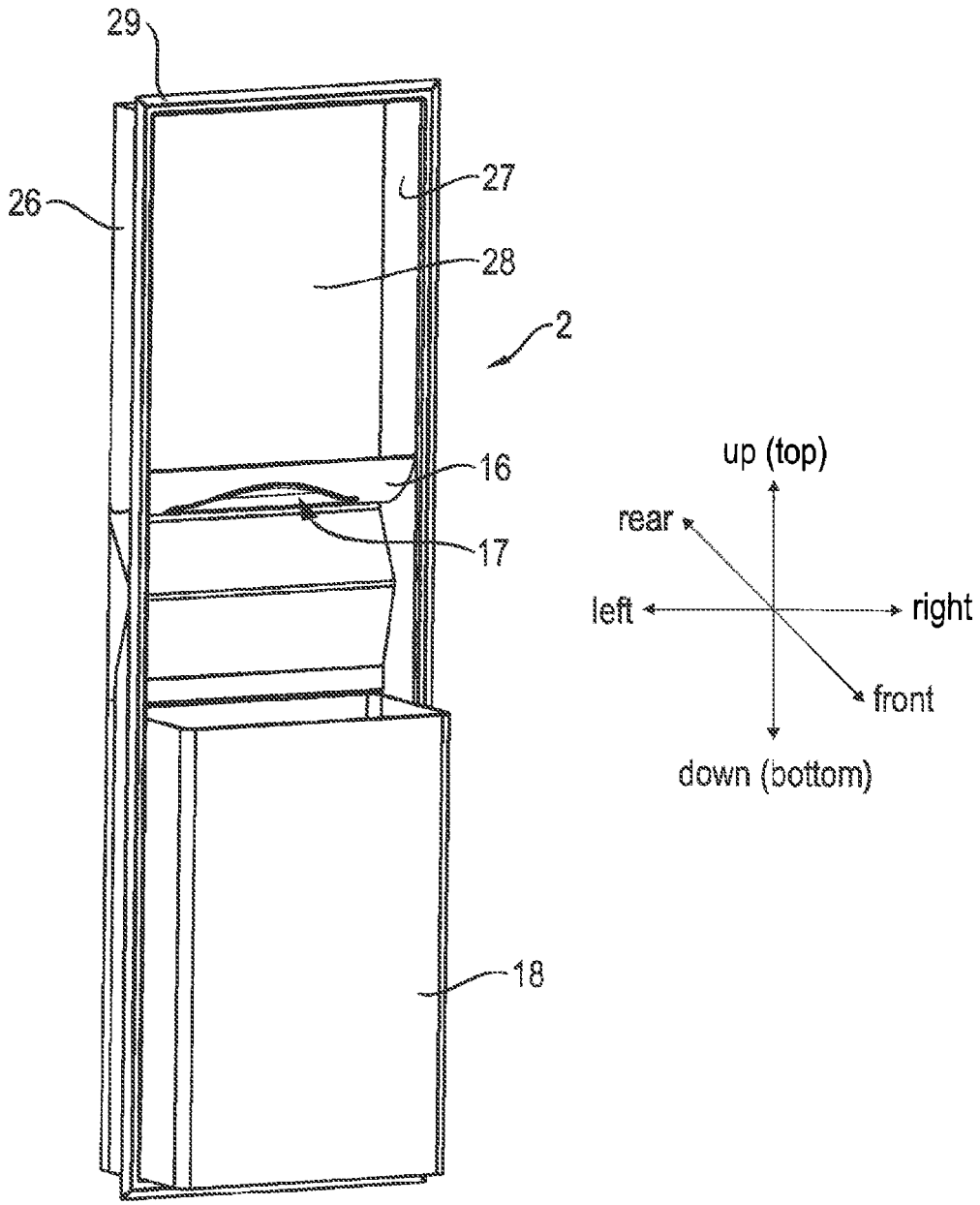
FIG. 1 is a perspective front view of a recessed dispenser cabinet.

Hereinafter, an embodiment according to the disclosure will be described in detail with reference to the accompanying drawings in order to describe the disclosure using illustrative examples. Further modifications of certain individual features described in this context can be combined with other features of the described embodiments to form further embodiments of the disclosure.

Throughout the drawings, the same reference numerals are used for the same elements.

FIG. 1 is a perspective front view of a recessed dispenser cabinet 2 in which the dispenser insert 1 of the present disclosure can be mounted. The recessed cabinet 2 comprises a first side wall 26, a second side wall 27 opposing the first side wall 26 and a rear wall 28 extending between the first side wall 26 and the second side wall 27. Moreover, the recessed cabinet 2 is provided with an abutting portion 29 which is configured to abut on the wall when the cabinet 2 is installed in the wall. The recessed cabinet 2 comprises a bottom wall 16 which is attached to the cabinet and in which a dispensing opening 17 is provided. In the embodiment shown in FIG. 1, the recessed cabinet 2 further comprises a bin 18 which is for disposal of used sheet products.

Figure 2:
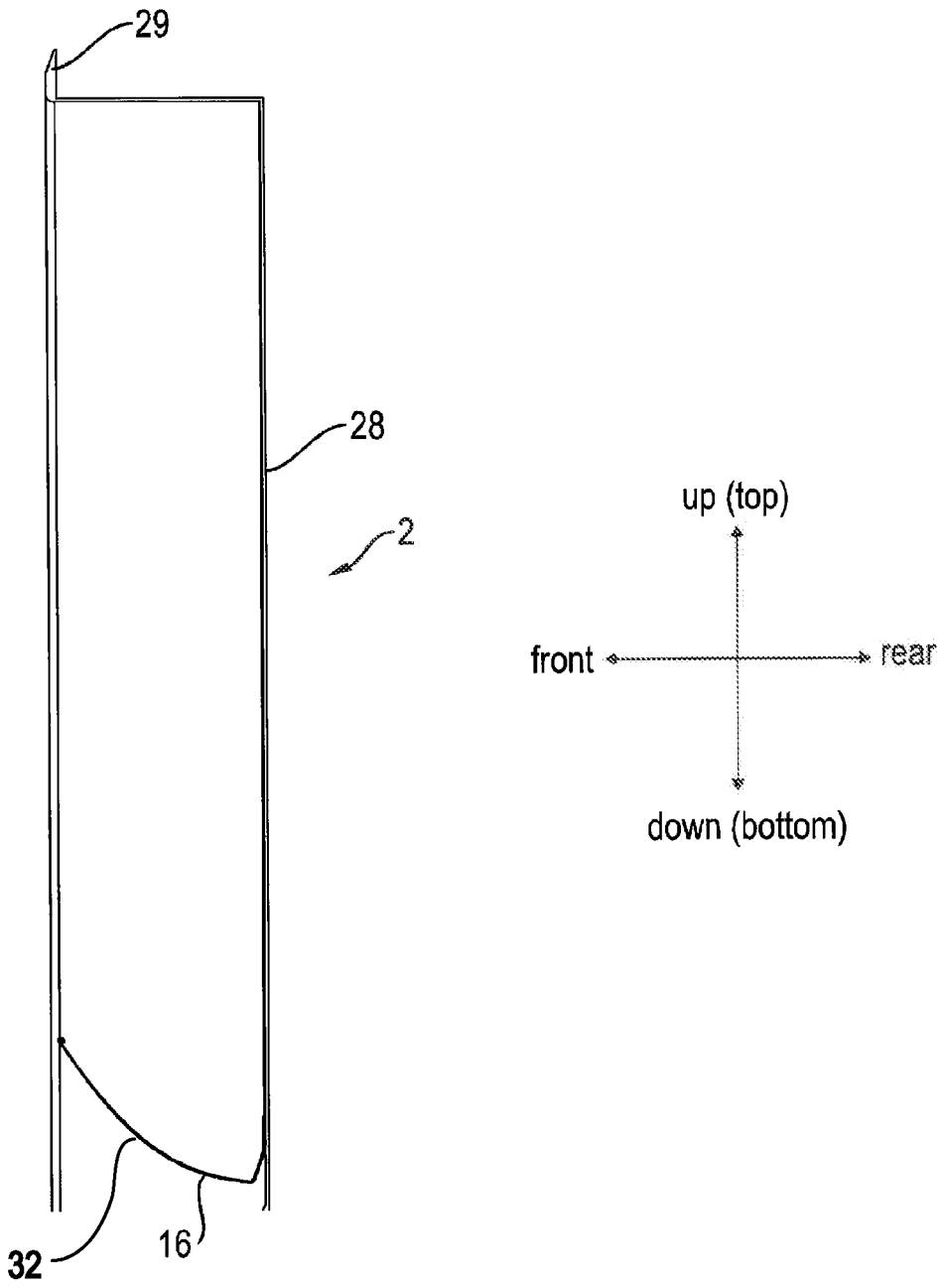
FIG. 2 is a side view of an upper portion of the recessed dispenser cabinet of FIG. 1.

FIG. 2 is a side view of an upper portion of the recessed dispenser cabinet 2 of FIG. 1. As seen from the side, the bottom wall 16 has a slanted or curved surface 32 extending from a lower rear position of the cabinet 2 to an upper front position of the cabinet 2.

Figure 3:
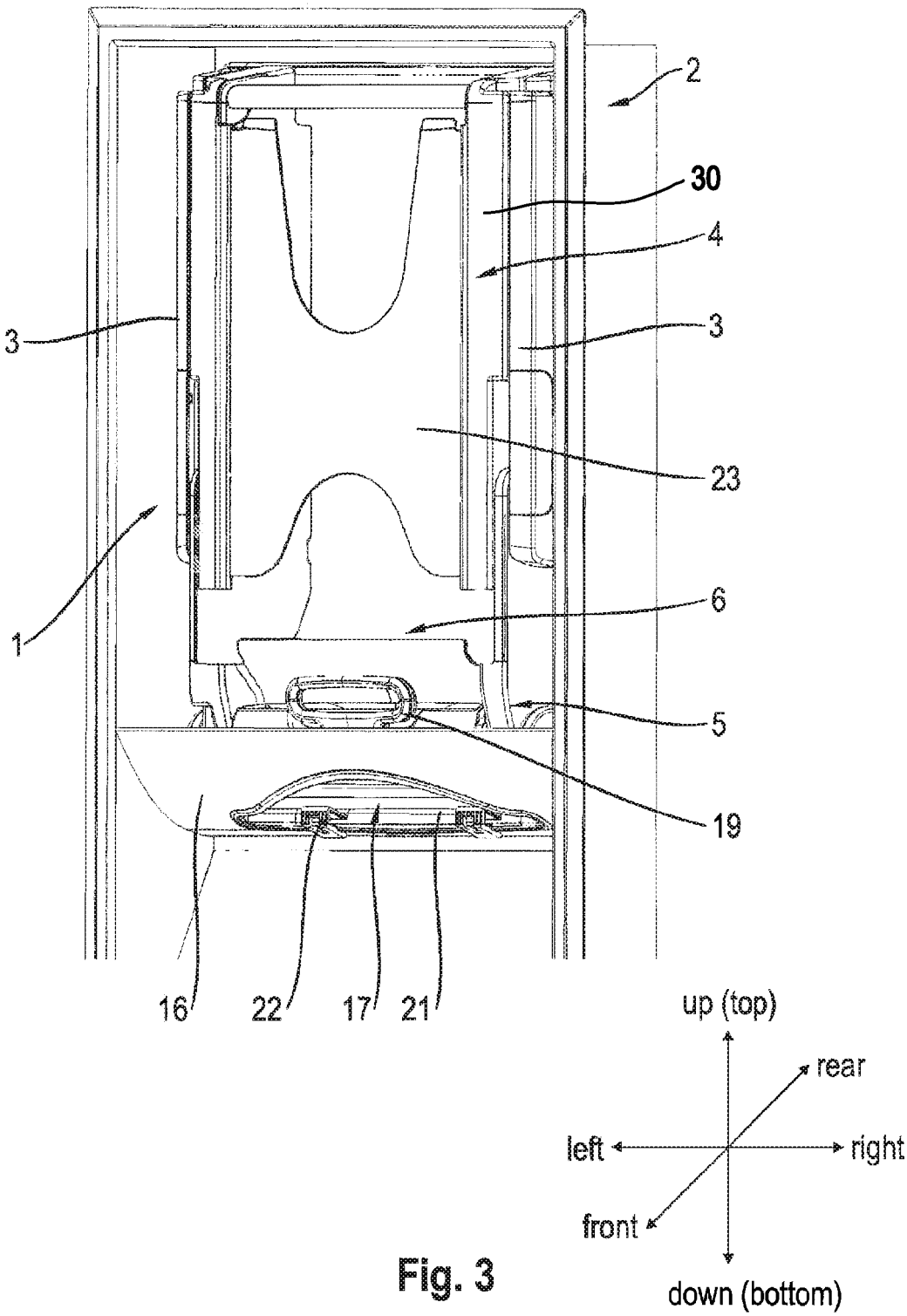
FIG. 3 is a perspective front view of a dispenser insert according to an embodiment mounted in the recessed cabinet of FIG. 1.

FIG. 3 is a perspective front view of the dispenser insert 1 according to the embodiment mounted in the recessed cabinet 2 of FIG. 1. The dispenser insert 1 comprises a frame 3 which is mounted in the cabinet 2 by means of a mounting structure 21 which is fastened to the rear edge of the dispensing opening 17 of the bottom wall 16 of the cabinet 2 by means of clips 22.

The dispenser insert 1 further comprises a dispensing mechanism 30 mounted to the frame 3 wherein the dispensing mechanism 30 comprises a magazine part 4 for accommodating a stack of sheet products and a dispensing part 5 for dispensing the sheet products. In the embodiment, the frame 3 comprises left and right side walls to which the magazine part 4 and the dispensing part 5 are respectively mounted. The magazine part 4 comprises a front wall 23 configured to prevent the stacks of sheet products from tilting out of the magazine part 4. A refilling access 6 for refilling the stacks of sheet products into the magazine part 4 is located at the bottom of the magazine part 4. As can be seen in FIG. 3, the dispensing part 5 is arranged below the refilling access 6.

The dispensing part 5 further comprises a handle 19 which enables a user to easily move the dispensing part 5 relative to the magazine part 4 into a refilling position.

Figure 4:
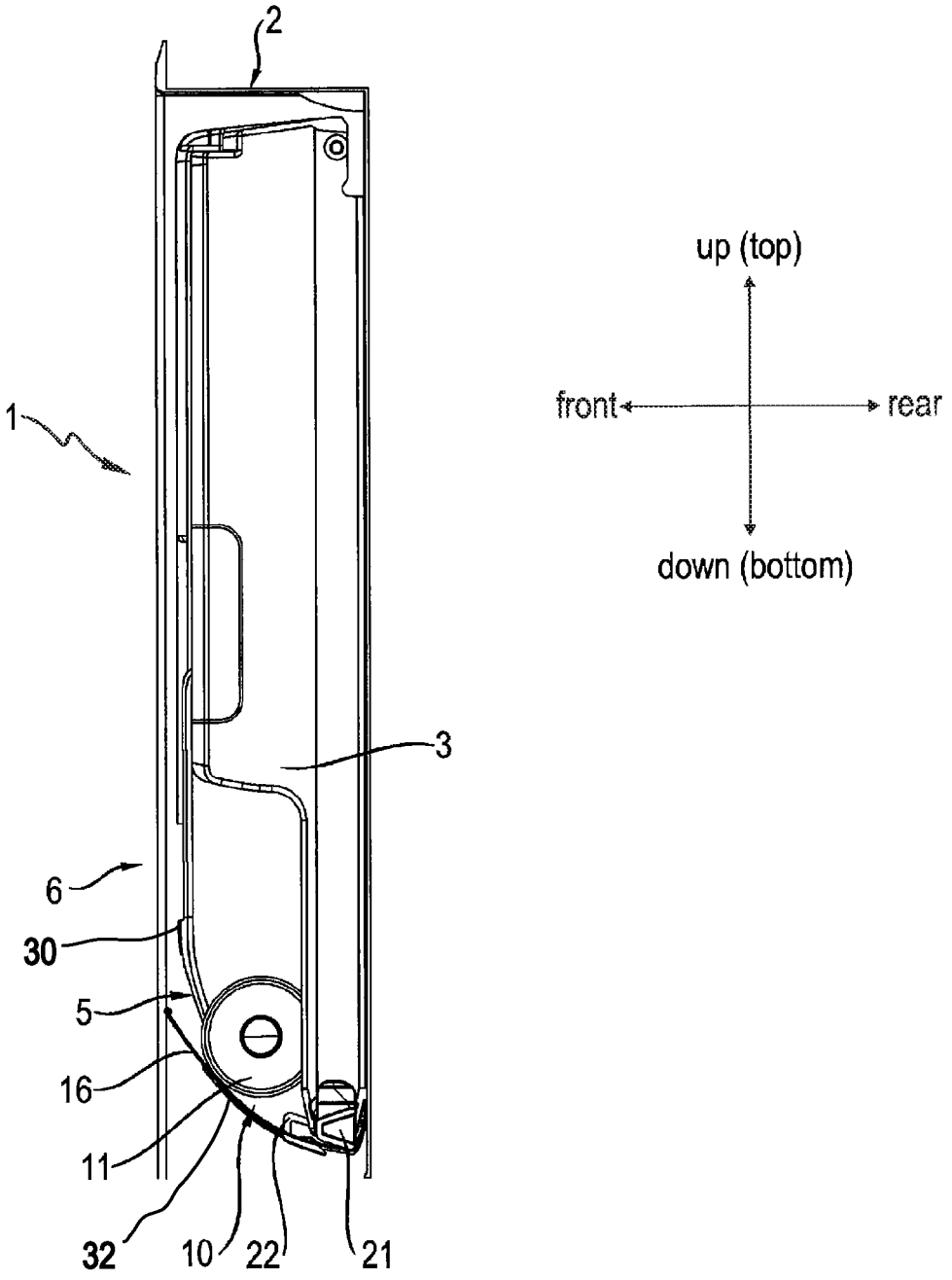
FIG. 4 is a side view of the dispenser insert of FIG. 3.

FIG. 4 is a side view of the dispenser insert 1 of FIG. 3. As can be seen, the dispenser insert 1 is arranged completely within the recessed cabinet 2. As previously explained, the frame 3 of the dispenser insert 1 is mounted in the cabinet 2 by means of the mounting structure 21. As can be seen, a lower portion of the frame 3 is connected to the mounting structure 21 and, in turn, the mounting structure 21 is connected to the bottom wall 16 with clips 22. Moreover, the dispensing part 5 is closely arranged at the dispensing opening 17 defined in the bottom wall 16 of the cabinet 2. With this configuration, a protruding part of the leading sheet is easily graspable through the dispensing opening 17 by a user.

The dispensing part 5 further comprises a guide 10 which is configured to be supported on the slanted surface 32 of the bottom wall 16 and to assist the translational and rotational movement of the dispensing part 5 relative to the magazine part 4. In the embodiment, the guide 10 comprises rotatable wheels 11 which are rotatably mounted on the dispensing part 5.

Figure 5:
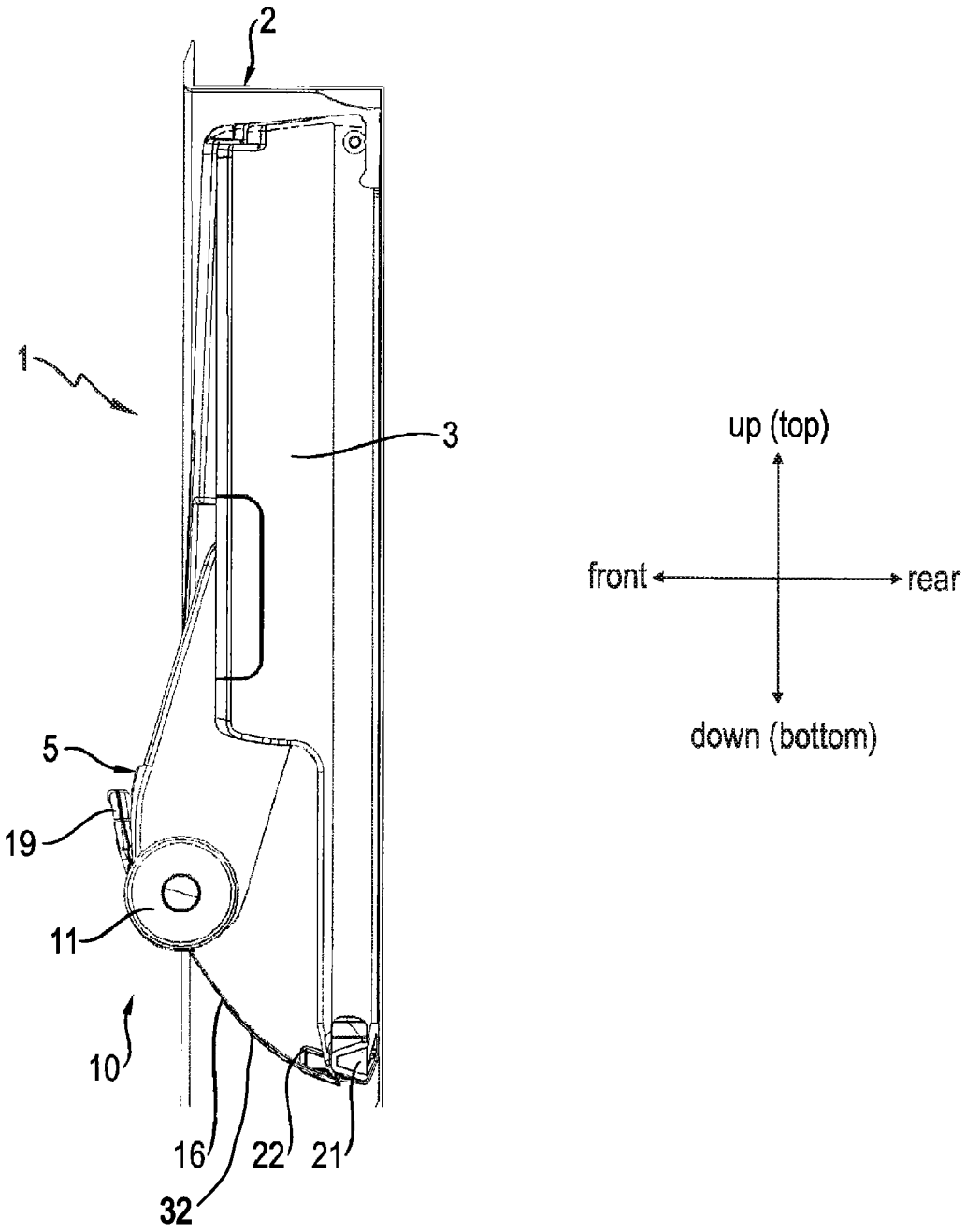
FIG. 5 is a side view of the dispenser insert of FIG. 3, wherein the dispensing part is in an upper position compared to the situation in FIG. 4.

FIG. 5 is a side view of the dispenser insert 1 of FIG. 3, wherein the dispensing part 5 is in an upper position compared to the situation in FIG. 4. More specifically, in comparison to the position of the dispensing part 5 in FIG. 4, the dispensing part 5 in FIG. 5 has been moved relative to the magazine part 4 from a lower rear position in the cabinet 2 to an upper front position in the cabinet 2. This is possible because, according to the embodiment, the dispensing part 5 is translationally and rotationally movable relative to the magazine part 4.

Figure 7:
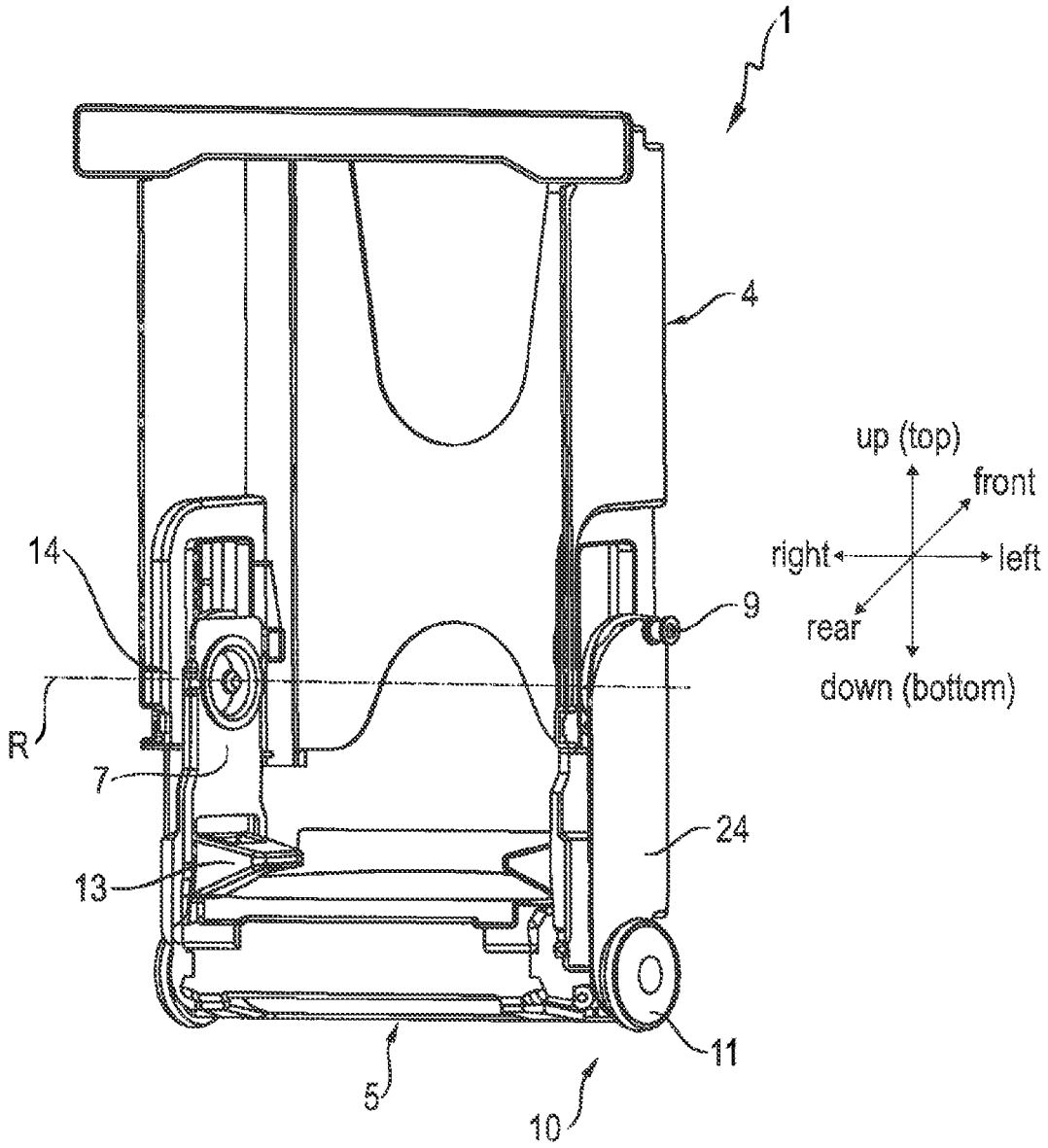
FIG. 7 is a perspective rear view of a part of the dispenser insert of FIG. 3.

More specifically, as more clearly shown in FIG. 7, the dispensing part 5 is rotatably mounted with its side surfaces 24 on a carriage 7, while the carriage 7 is translationally mounted on the magazine part 4. The movement of the dispensing part 5 can be described by a combination of a translational movement of the dispensing part 5 relative to the magazine part 4 in an upward direction and an upwardly rotational movement of the dispensing part 5 relative to the magazine part 4 about an axis of rotation R, i.e. away from the rear wall of the cabinet 2.

According to the embodiment, this movement is assisted by the rotatable wheels 11. This is because when a user pulls the handle 19 in a front direction, the rotatable wheels 11 roll over the slanted surface 32 of the bottom wall 16 of the cabinet 2, thereby automatically urging the dispensing part 5 in a front and upward direction. Without the provision of the rotatable wheels 11, a user would at first need to pull the handle 19 in a strictly upward direction in order to move the dispensing part 5 away from the bottom wall 16 and subsequently pull the handle 19 in a front direction in order to rotate the dispensing part 5 into the refilling position. This would require more attention from a user. Hence, with the configuration according to the embodiment, the dispensing part 5 can be brought into the refilling position more easily.

Figure 6:
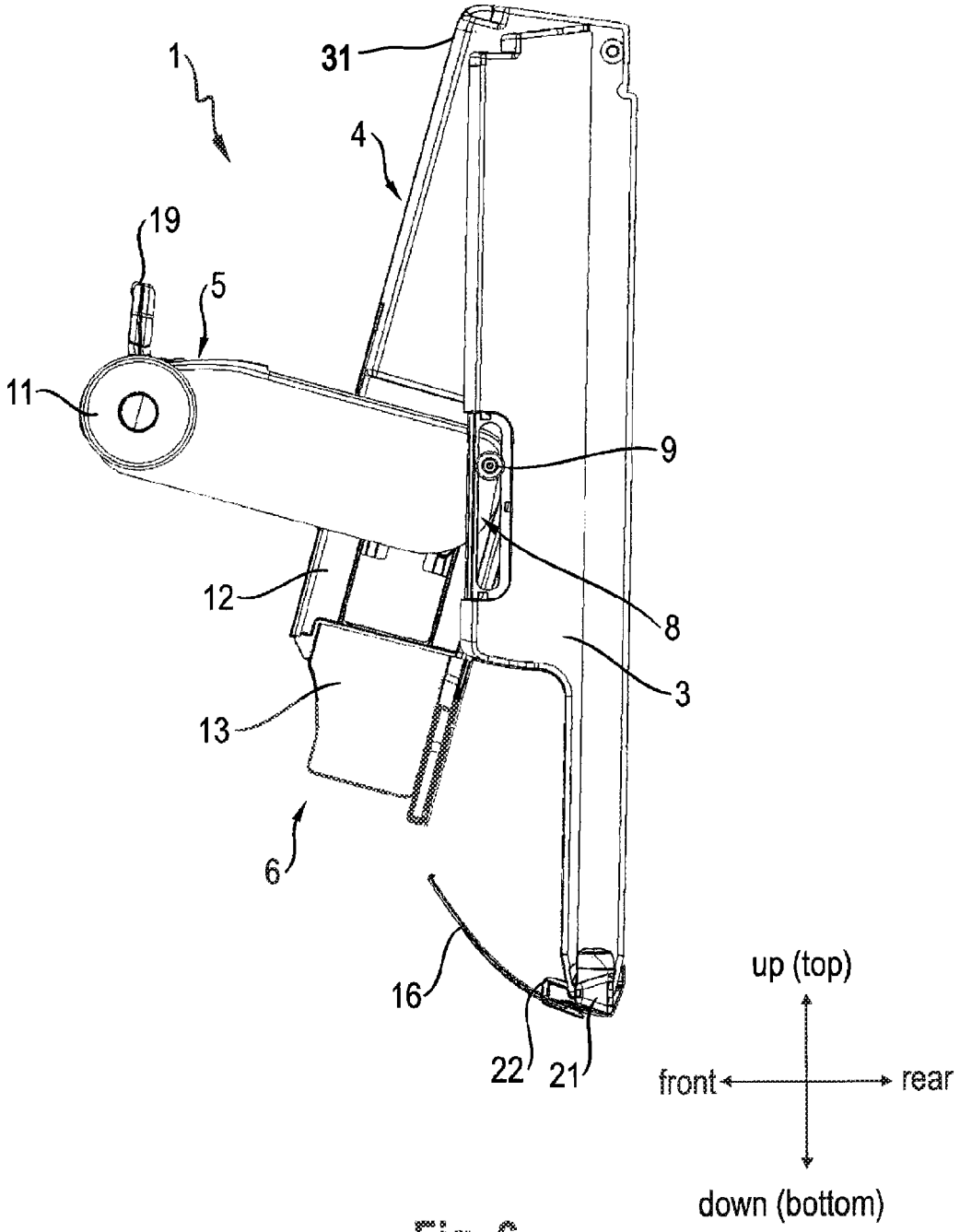
FIG. 6 is a side view of the dispenser insert of FIG. 3, wherein the dispensing part is in the refilling position.

FIG. 6 is a side view of the dispenser insert 1 of FIG. 3, wherein the dispensing part 5 is in the refilling position. As can be seen, in the refilling position, the magazine part 4 is pivoted out of the frame 3 toward the front direction such that the refilling access 6 is completely exposed from the bottom wall 16 of the cabinet 2.

Starting from the position of the dispensing part 5 shown in FIG. 5, the dispensing part 5 is brought into the refilling position by pulling the handle 19 further upwards. More specifically, as shown in FIG. 7, the dispensing part 5 is rotatable relative to the magazine part 4 about the axis of rotation R which passes through the side surfaces 24 of the dispensing part 5. Furthermore, the dispensing part 5 comprises a pin 9 which is respectively arranged on each side surface 24 of the dispensing part 5 at a position which is located closer to a front edge of the side surface 24 than the position where the axis of rotation R passes through the side surface 24. In other words, the pin 9 is arranged eccentric from the axis of rotation R.

Further, as shown in FIG. 6, the pin 9 is engaged with a guide slot 8 which is formed in a front portion of the frame 3, respectively in both side walls of the frame 3. As a result, when the dispensing part 5 is rotationally moved relative to the magazine part about the axis of rotation R, since the pin 9 is eccentrically arranged on the dispensing part 5 and engaged with the slot 8 formed in the frame 3, the magazine part 4 is moved relative to the frame 3. Further, since the magazine part 4 is rotatably attached to the frame 3 at an end 31 of the magazine part 4 opposite to the refilling access 6, i.e. at an upper rear end of the magazine part 4, the magazine part 4 is rotated or pivoted relative to the frame 3 upon rotation of the dispensing part 5 relative to the magazine part 4 into the refilling position.

Figure 8:
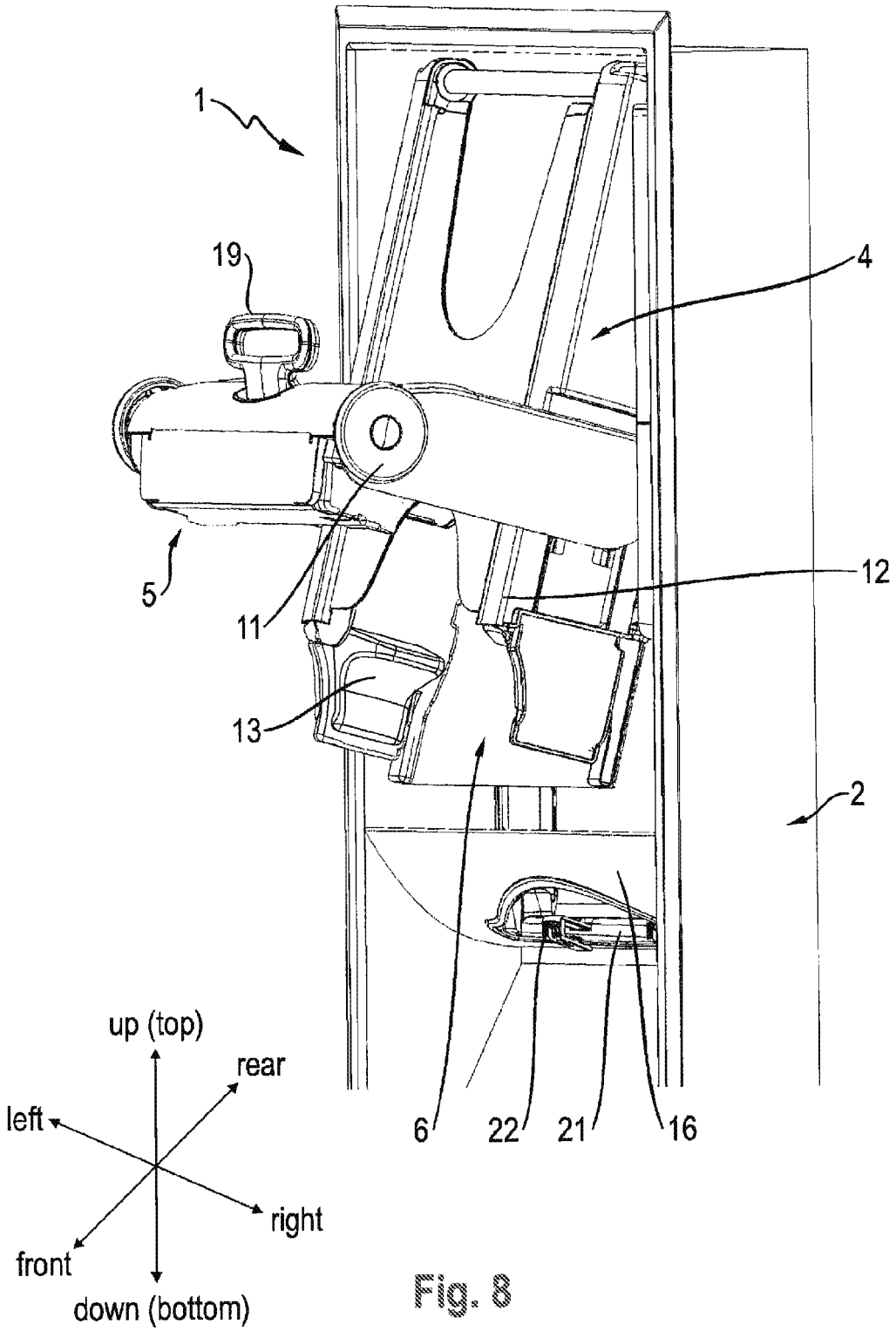
FIG. 8 is a perspective front view of the dispenser insert of FIG. 3, wherein the dispensing part is in the refilling position.

In the refilling position of the dispensing part 5, which is also shown in FIG. 8 in a perspective front view of the dispenser insert 1, the dispensing part 5 is temporarily held in the refilling position by means of a holding mechanism 14 which, in the embodiment, comprises a friction brake 15. The friction brake 15 is respectively located at a position where the dispensing part 5 is connected via the carriage 7 to the magazine part 4.

Figure 9:
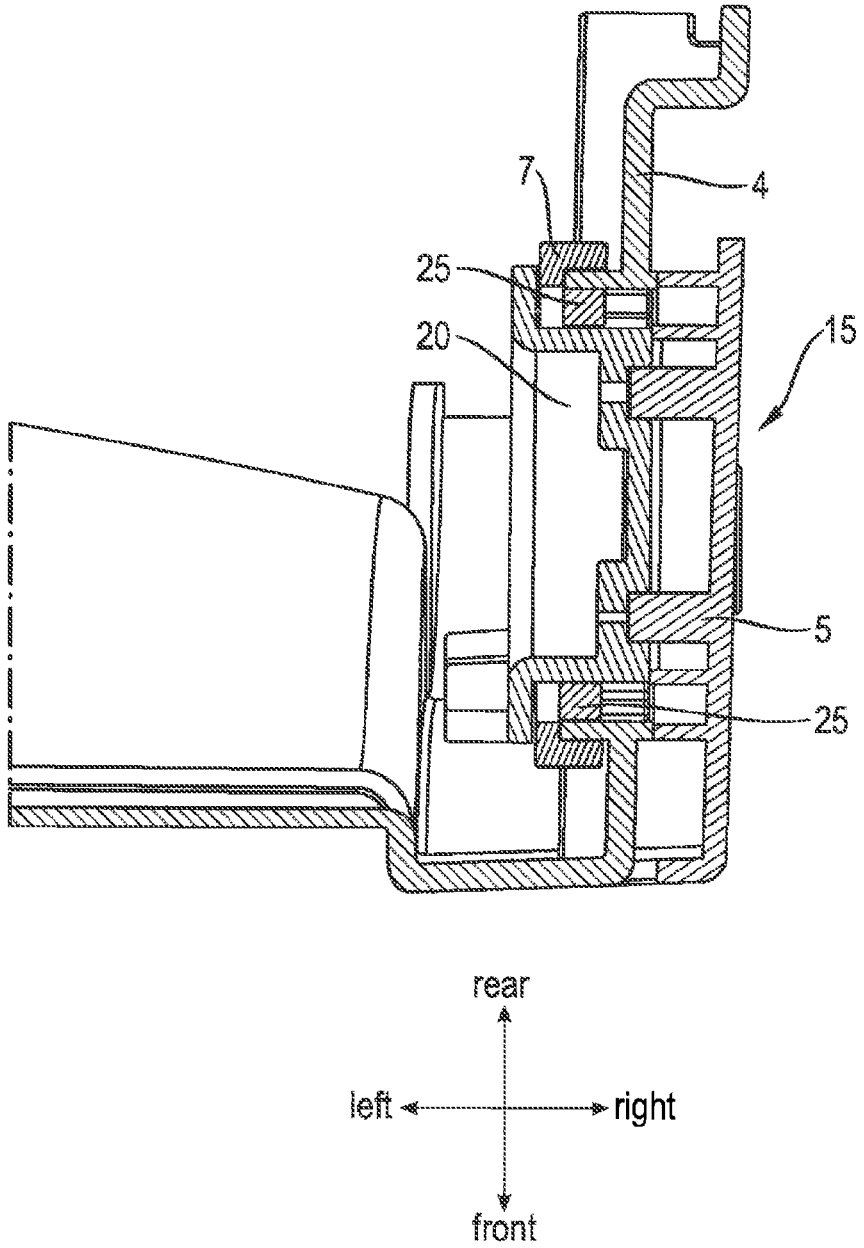
FIG. 9 is a cross-sectional top view of the friction brake of the dispenser insert of FIG. 3.

The mechanism of the friction brake 15 is shown in the cross-sectional top view of the friction brake 15 in FIG. 9. In the embodiment, the dispensing part 5 is connected to the carriage 7 via a bushing 20. The bushing 20 may have an oval shape and be rotatably mounted on the carriage 7. When the dispensing part 5 is rotated relative to the magazine part 4, the bushing 20 is rotated relative to the carriage 7. The bushing 20 is mounted on the carriage 7 such that end portions of the bushing 20 which, due to the oval shape of the bushing 20, are located further away from the center of the bushing 20 than other end portions thereof, press against respective movable portions 25 of the carriage 7. In turn, the movable portions 25 of the carriage 7 press against respective portions of the magazine part 4 which, in turn, inhibits the movement of the dispensing part 5 upon movement into the refilling position. Also the translational movement of the carriage 7 relative to the magazine part 4 is inhibited by this mechanism of the friction brake 15.

In the refilling position, the force exerted by the friction brake 15 acting on the dispensing part 5 is sufficiently strong such that the dispensing part 5 can be temporarily held in the refilling position. Hence, a user does not need to hold the dispensing part 5 with his hands while refilling the magazine part 4 with stacks of sheet products.

As shown in FIG. 8, the magazine part 4 comprises a body 12 and supports 13 configured to support the stack of sheet products. The supports 13 are respectively provided at a lower end portion of the side wall of the magazine part 4. In the embodiment, as shown in FIG. 7, the supports 13 are respectively connected to the carriage 7. Therefore, the supports 13 are translationally movable relative to the body 12 upon translational movement of the dispensing part 5 relative to the magazine part 4. When the dispensing part 5 is moved relative to the magazine part 4 into the refilling position, initially, the dispensing part 5 is translationally moved in an upward direction. Therefore, the supports 13 are translationally moved in an upward direction as well. As a result, the distance in the up-down direction between the supports 13 and a top end of the magazine part 4 is shortened, thereby reducing the interior space of the magazine part 4 in this direction. Hence, when the dispensing part 5 is in the refilling position, the interior space of the magazine part 4 is reduced, thereby allowing only a reduced number of sheet products to be refilled in the magazine part compared to a situation in which the supports 13 are not positioned in an upper position.

After refilling the magazine part 4, when the dispensing part 5 is moved back into the recessed cabinet 2, the supports 13 are translationally moved relative to the body 12 in a lower position, thereby enlarging the interior space in the magazine part 4 in the up-down direction. As a result, even if the stacks of sheet products are densely packed during refilling of the magazine part 4, when the supports 13 return in the lower position upon moving the dispensing part 5 back into the recessed cabinet 2, the interior space of the magazine part 4 is enlarged, which reduces the density of the packing of the stacks of sheet products. Accordingly, with this configuration, overfilling of the magazine part 4 with sheet products can be prevented.

Next, a method for refilling the dispenser insert 1 according to the embodiment will be described.

In the first step, the dispensing part 5 is translationally moved upward relative to the magazine part 4. In the second step, the dispensing part 5 is rotationally moved relative to the magazine part 4 in a front upward direction, i.e. away from the rear wall of the recessed cabinet 2. The movements of the first and the second step may also at least overlap, i.e. at least partially take place at the same time. In the third step, the magazine part 4 is refilled with stacks of sheet products. In the fourth step, the dispensing part 5 is rotationally moved relative to the magazine part 4 in a down rearward direction, i.e. toward the rear wall of the recessed cabinet 2. In the fifth step, the dispensing part 5 is translationally moved downward relative to the magazine part 4 until the rotatable wheels 11 touch the bottom wall 16 of the cabinet 2.

LIST OF REFERENCE SIGNS

1 dispenser insert
2 existing cabinet
3 frame
4 magazine part
5 dispensing part
6 refilling access
7 carriage
8 guide slot
9 pin
10 guide
11 rotatable wheel
12 body
13 support
14 holding mechanism
15 friction brake
16 bottom wall
17 dispensing opening
18 bin
19 handle
20 bushing
21 mounting structure
22 clip
23 front wall (of the magazine part)
24 side surface (of the dispensing part)
25 movable portion (of the carriage)
26 first side wall (of the cabinet)
27 second side wall (of the cabinet)
28 rear wall (of the cabinet)
29 abutting portion (of the cabinet)
30 dispensing mechanism
31 end (of the magazine part)
32 slanted surface
R axis of rotation (rotation of the dispensing part relative to the magazine part)

The invention claimed is:

1. A dispenser insert for being mounted in an existing cabinet, the dispenser insert comprising:

a frame configured to be mounted in the existing cabinet, a dispensing mechanism mounted to the frame, the dispensing mechanism comprising a magazine part for accommodating a stack of sheet products and a dispensing part for dispensing the sheet products, the magazine part having a refilling access at its bottom, wherein the magazine part comprises a body mounted to the frame, wherein the dispensing part is translationally and rotationally moveable relative to the magazine part into a refilling position.

2. The dispenser insert according to claim 1, wherein the dispensing part is rotatably mounted on a carriage, the carriage being translationally moveable relative to the magazine part.

3. The dispenser insert according to claim 1, wherein an end of the magazine part opposite to the refilling access is rotatably attached to the frame.

4. The dispenser insert according to claim 3, wherein the frame has a guide slot and the dispensing part has a pin engaged with the guide slot, whereby the magazine part is rotated relative to the frame upon rotation of the dispensing part relative to the magazine part.

5. The dispenser insert according to claim 1, wherein the dispensing part comprises a guide configured to be supported on a slanted surface of the existing cabinet and to assist the translational and rotational movement of the dispensing part relative to the magazine part.

6. The dispenser insert according to claim 5, wherein the guide comprises a rotatable wheel.

7. The dispenser insert according to claim 1, wherein the magazine part comprises the body and a support configured to support the stack of sheet products, the support being translationally moveable relative to the body upon translational movement of the dispensing part relative to the magazine part.

8. The dispenser insert according to claim 1, further comprising a holding mechanism configured to temporarily hold the dispensing part in the refilling position.

9. The dispenser insert according to claim 8, wherein the holding mechanism comprises a friction brake configured to inhibit the movement of the dispensing part upon movement into the refilling position, whereby the dispensing part is temporarily held in the refilling position.

10. The dispenser insert according to claim 1, wherein the dispensing part is arranged below the refilling access.

11. The dispenser insert according to claim 1, wherein the existing cabinet is recessed.

12. A method for refilling a dispenser comprising a dispensing mechanism having a magazine part for accommodating a stack of sheet products and a dispensing part for dispensing the sheet products, the magazine part having a refilling access at its bottom, the method comprising the steps of:

i) translationally moving the dispensing part relative to the magazine part in a first translational direction, ii) rotationally moving the dispensing part relative to the magazine part in a first rotational direction, iii) refilling the magazine part with the sheet products.

13. The method according to claim 12, wherein the method further comprises the steps of:

iv) rotationally moving the dispensing part relative to the magazine part in a second rotational direction being opposite to the first rotational direction, v) translationally moving the dispensing part relative to the magazine part in a second translational direction being opposite to the first translational direction.

14. The method according to claim 12, wherein the translational and rotational movements of steps i) and ii) at least overlap.

* * * * *